US010041672B2

(12) United States Patent
Zhdaneev

(10) Patent No.: US 10,041,672 B2
(45) Date of Patent: Aug. 7, 2018

(54) REAL-TIME BURNER EFFICIENCY CONTROL AND MONITORING

(71) Applicant: SCHLUMBERGER TECHNOLOGY CORPORATION, Sugar Land, TX (US)

(72) Inventor: Oleg Zhdaneev, Bergen (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 380 days.

(21) Appl. No.: 14/109,702

(22) Filed: Dec. 17, 2013

(65) Prior Publication Data

US 2015/0167972 A1 Jun. 18, 2015

(51) Int. Cl.

| | |
|---|---|
| ***F23D 14/00*** | (2006.01) |
| ***F23N 5/00*** | (2006.01) |
| ***F23G 7/08*** | (2006.01) |
| ***F23N 5/24*** | (2006.01) |
| ***F23N 1/02*** | (2006.01) |

(Continued)

(52) U.S. Cl.

CPC ..... *F23N 5/003* (2013.01); *F23G 5/50* (2013.01); *F23G 7/08* (2013.01); *F23G 7/085* (2013.01); *F23N 1/022* (2013.01); *F23N 5/08* (2013.01); *F23N 5/242* (2013.01); *F23G 2207/00* (2013.01); *F23N 2023/00* (2013.01); *F23N 2039/04* (2013.01); *F23N 2041/12* (2013.01)

(58) Field of Classification Search

CPC .... E21B 43/243; E21B 43/24; E21B 43/2401; E21B 43/247; E21B 43/30; E21B 43/305; E21B 17/028; E21B 47/02208; E21B 43/168; E21B 36/04; E21B 43/166; E21B 17/10; E21B 36/00; E21B 36/02; E21B 41/0071; E21B 41/005; F23N 1/02; F23N 2021/08; F23N 2021/12; F23N 2025/10; F23N 2025/21; F23N 2029/20; F23N 2041/18; F23N 5/00; F23N 5/003; F23N 5/006; F23N 5/082; F23N 1/085

USPC ..... 431/76

See application file for complete search history.

(56) References Cited

U.S. PATENT DOCUMENTS 3,658,015 A * 4/1972 Griffin, III ..... E21B 41/0071 110/237
3,816,059 A * 6/1974 Straitz, III ..... F23Q 9/00 431/192

(Continued)

FOREIGN PATENT DOCUMENTS

| | | |
|---|---|---|
| CA | 2808707 A1 | 5/2013 |
| WO | 2010147496 A1 | 12/2010 |
| WO | 2017/058832 A1 | 4/2017 |

OTHER PUBLICATIONS

Kinal, Kurt, "Well Testing Adjustment to Marine Park", MEA News, Spring 2006, p. 25.

(Continued)

*Primary Examiner* — Jason Lau

(57) ABSTRACT

A method for real-time burner monitoring and control of a flare system, including analyzing a flare gas and/or flare exhaust gas by one or more analytical techniques and determining the flare gas and/or flare exhaust gas composition. The method may also include an ash particle monitoring system. The method further includes an analytical control unit for real-time adjustment of process conditions.

19 Claims, 3 Drawing Sheets

(51) Int. Cl.
*F23N 5/08* (2006.01)
*F23G 5/50* (2006.01)

(56) References Cited

U.S. PATENT DOCUMENTS 3,875,998 A * 4/1975 Charpentier ..... B01D 19/0063 166/357
3,913,560 A * 10/1975 Lazarre ..... B01D 57/00 126/360.1
4,059,385 A * 11/1977 Gulitz ..... F23N 1/02 431/12
4,092,095 A * 5/1978 Straitz, III ..... F23D 14/24 431/114
4,255,120 A * 3/1981 Straitz, III ..... E21B 41/0071 169/69
4,268,245 A * 5/1981 Straitz, III ..... E21B 41/0071 431/202
4,482,364 A * 11/1984 Martin ..... B01D 19/0031 96/188
4,505,668 A * 3/1985 DiBiano ..... F23G 7/085 431/202
4,516,932 A * 5/1985 Chaudot ..... E21B 41/0071 431/114
4,614,491 A * 9/1986 Welden ..... F23N 1/005 431/281
4,652,233 A * 3/1987 Hamazaki ..... F23G 7/08 431/202
4,749,122 A * 6/1988 Shriver ..... F23N 1/022 122/448.1
4,871,307 A * 10/1989 Harris ..... F23N 5/123 327/512
4,913,647 A * 4/1990 Bonne ..... F23N 1/022 431/12
4,942,772 A * 7/1990 Welker ..... G01N 1/2258 73/863.83
4,961,703 A * 10/1990 Morgan ..... F23G 7/085 137/251.1
5,197,826 A * 3/1993 Korloo ..... E21B 41/0071 405/195.1
5,231,939 A * 8/1993 Tanaka ..... F23N 1/022 110/186
5,275,553 A * 1/1994 Frish ..... F23N 5/003 250/338.5
5,599,179 A * 2/1997 Lindner ..... F23N 1/02 431/12
5,807,750 A * 9/1998 Baum ..... G01N 21/31 250/341.1
5,919,036 A * 7/1999 O'Brien ..... B01D 45/04 431/2
5,988,079 A * 11/1999 Carter ..... F23N 5/003 110/185
6,231,334 B1 * 5/2001 Bussman ..... F23D 14/34 431/202
6,341,519 B1 * 1/2002 Khesin ..... G01N 27/407 204/424
6,360,680 B1 * 3/2002 Breen ..... F23C 5/12 110/101 C
6,389,330 B1 * 5/2002 Khesin ..... F23N 5/082 431/14
6,435,860 B1 8/2002 Brookshire et al.
7,128,818 B2 * 10/2006 Khesin ..... G01N 27/407 204/424
7,217,121 B2 * 5/2007 Thomson ..... B08B 7/00 250/339.01
8,013,995 B2 * 9/2011 Massoli ..... G01N 15/0211 356/336
2008/0221798 A1 * 9/2008 Pariag ..... G01V 9/00 702/9
2008/0233523 A1 9/2008 Diepenbroek et al.
2009/0029300 A1 * 1/2009 Ponzi ..... F23D 14/08 431/12
2009/0151426 A1 * 6/2009 Shah ..... E21B 47/10 73/23.35
2009/0233248 A1 * 9/2009 Dhulst ..... F23D 14/16 431/2
2009/0321645 A1 * 12/2009 Hinnrichs ..... G01J 5/061 250/338.5
2010/0127163 A1 * 5/2010 Zhdaneev ..... G01N 1/38 250/282
2010/0313674 A1 * 12/2010 Dutel ..... G01F 1/7086 73/861
2011/0085030 A1 4/2011 Poe et al.
2011/0107944 A1 * 5/2011 Terushita ..... F22B 35/002 110/204
2011/0195364 A1 * 8/2011 Tullos ..... F23G 7/085 431/2
2011/0301910 A1 * 12/2011 Spellicy ..... G01N 21/274 702/135
2012/0053838 A1 * 3/2012 Andrews ..... E21B 49/082 702/8
2012/0150451 A1 6/2012 Skinner et al.
2013/0125554 A1 * 5/2013 Mittricker ..... F01K 23/10 60/772
2013/0125799 A1 5/2013 Fried et al.
2013/0247684 A1 * 9/2013 Suda ..... E21B 43/34 73/861.04
2013/0255486 A1 * 10/2013 Hall ..... B01D 53/24 95/34
2015/0167972 A1 6/2015 Zhdaneev

OTHER PUBLICATIONS

Sealy, Ian, "Positive Measures", Interchange, Jan. 2007, pp. 28-29.
U.S. PCT Application No. PCT/RU2013/000797 filed Sep. 13, 2013; 19 pages.
International Search Report and Written Opinion issued in related PCT PCT/US2014/066852 application on Feb. 3, 2015, 12 pages.
International Search Report and Written Opinion for PCT Application Serial No. PCT/US2016/054041 dated Jan. 16, 2017, 13 pages.

* cited by examiner

REAL-TIME BURNER EFFICIENCY CONTROL AND MONITORING

BACKGROUND

Ability to perform drilling operations with minimal environmental impact has becomes a key to successful operation in oil and gas industry. Parts of well test operations require the operators to flare a portion of the fluid that is produced during the test when there is no way to transport the formation fluid to the market. In addition produced/separated gas is flared at the well site when operator cannot use the gas for other purposes.

SUMMARY OF THE CLAIMED EMBODIMENTS

This summary is provided to introduce a selection of concepts that are further described below in the detailed description. This summary is not intended to identify key or essential features of the claimed subject matter, nor is it intended to be used as an aid in limiting the scope of the claimed subject matter.

Illustrative embodiments of the present disclosure are directed to a system for real-time burner control and monitoring of a flare system. The system includes a separator that receives flare gas from a flow header, and separates the flare gas into two or more fractions, a flare system, located downstream from the separator, for the handling and burning of the flare gas, and an air supply unit for supplying oxidant gas. The system further includes a flare gas sampling point downstream of the separator and upstream of the flare system, an exhaust gas sampling point downstream of the flare system, and an analytical control unit configured to compare the results obtained at each sampling point.

Also, various embodiments of the present disclosure are directed to a method for real-time burner control and monitoring of a flare system. The method includes feeding a flare gas to the system through a flow header, separating, in a separator, the flare gas received from the flow header into one or more fractions, and burning one or more fractions of the flare gas in a flare system. The method further includes analyzing the flare exhaust gas composition downstream of the flare system, identifying specific components in the flare exhaust, analyzing the flare gas at a point upstream of the flare system, and monitoring the flare burner efficiency by differential composition analysis between the flare gas and flare exhaust.

Other aspects and advantages will be apparent from the following description and the appended claims.

DETAILED DESCRIPTION

In one aspect, embodiments disclosed herein relate to a proposed method for implementing chromatographic, spectrometric, and optical systems for a compositional analysis of formation fluids in a surface environment, including but not limited to live oils and separator gas, for the purpose of the real time flare performance optimization and mitigation of any environmental impact. The disclosure utilizes chromatographic, spectrometric, and optical techniques for mixture analysis methods. The methods described in this document utilize chromatographic, spectrometric, and optical analysis for the quality control and flare system performance tuning. The operating software includes an algorithm to predict chromatographic, spectrometric, and optical system response of the flare exhaust based on the analysis of the mixture sampled from the gas supply line, compared with the flare exhaust analysis results and automatically adjusting separator parameters and air supply flowrates. This disclosure provides control and monitoring systems and methods for flare system operation.

In one aspect, embodiments herein relate to the system and method of a real time monitoring system that would establish a basis for effective real time burner optimization, as the absence of such a system can potentially lead to environmental hazards.

Several approaches for this system and method, based on the hazards and regulations related to the process fluids that are being processed, are disclosed herein. In one embodiment, a method to identify the presence of specific hazardous components such as ash, carbon monoxide, carbon dioxide, nitric oxide, nitrogen dioxide, mercury, benzene, vanadium, mercaptans, hydrogen sulfide and other such compounds present in conventional flare systems, and define a "standard" composition of the fluid is disclosed. A "standard" composition is defined herein as the composition of the exhaust gas prior to any system adjustments.

For this proposed method, a combination of the analytical instruments may be utilized. The analytic instruments, together, form one or more analytical chemistry package and may contain one or more of ion mobility spectrometry, differential mobility spectrometry, isobaric sampling, isothermal sampling, gas chromatograph, mass-spectroscopy, real-time optical spectrometry, ash filters, optical emitter-detector package, multi wavelength emitter-detector, broadband emitter-detector on specific wavelengths for low resolution scanning (e.g. C1, C2, C3-C5, C6+), and injectors to the analytical instruments. These analytical chemistry packages may be located upstream or downstream of the burner, or may be located both upstream and downstream of the burner (i.e., two packages).

Figure 1:
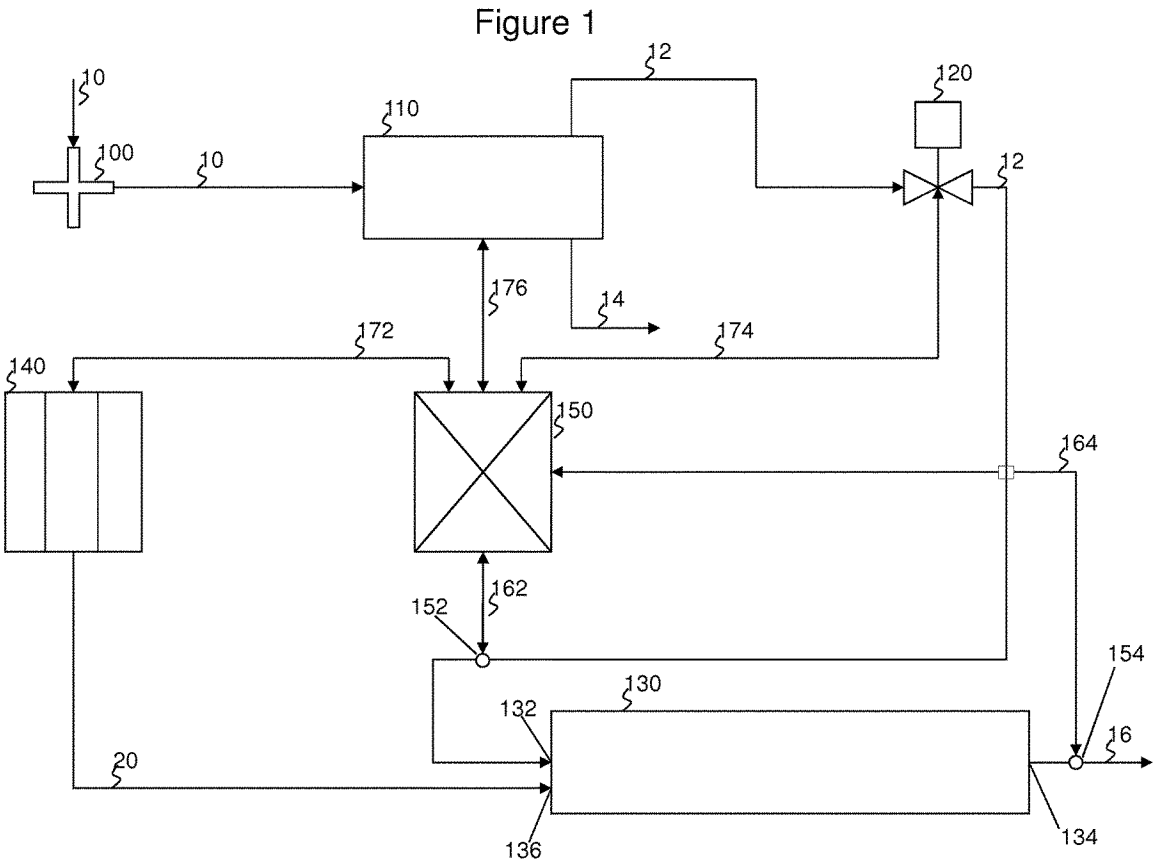
FIG. 1 illustrates a process flow diagram according to embodiments disclosed herein.

Referring now to FIG. 1, a system according to embodiments disclosed herein is illustrated.

Raw flare gas 10 is introduced to the system via a flow header 100. Flow header 100 is configured to feed raw flare gas 10 to a separator 110 which is located downstream of the flow header 100 and configured to receive the raw flare gas 10 from the flow header 100. Separator 110 separates the raw flare gas 10 into two or more fractions based on the type of flare gas received. The separator 110 may be a wet/dry gas separator, a liquid/gas hydrocarbon separator, or a water knock out separator. According to one or more embodiments disclosed herein, separator 110 is a liquid/gas hydrocarbon separator configured to separate raw flare gas 10 into flare gas 12 and liquid hydrocarbon 14. Liquid hydrocarbon 14 may be sent to a liquid flare system (not illustrated), recycled upstream of flare header 100 (not illustrated), or shipped as product.

Flare gas 12 is fed to a choke valve 120 which is configured to control the flowrate of flare gas 12 exiting separator 110. Downstream of choke valve 120, flare gas 12 is fed to flare system 130. Flare system 130 may be any type of existing or new installation flare system utilized by any process which handles hydrocarbons. According to one or more embodiments disclosed herein, the flare system 130 is installed at a well head for drilling operations and contains a flare gas inlet 132, a flare exhaust outlet 134, an oxidant gas inlet 136, and a flare header containing at least one pilot flame. Flare gas 12 is burned in flare system 130, in the presence of oxidant 20, and produces flare exhaust 16. Flare exhaust 16 may contain one or more environmentally hazardous compounds such as ash, carbon monoxide, carbon dioxide, nitric oxide, nitrogen dioxide, mercury, benzene, vanadium, mercaptans, hydrogen sulfide and other such compounds present after conventional flare systems.

The system, according to one or more embodiments describes herein, is also equipped with sampling and feedback systems. The sampling system contains a flare gas sampling point 152 and an exhaust gas sampling point 154. Flare gas sampling point 152 may be located anywhere downstream of separator 110, in some embodiments downstream of choke valve 120, and in some embodiments proximate the flare gas inlet 132 but prior to oxidant gas inlet 136 and admixture of oxidant gas 20. Exhaust gas sampling point 154 may be located anywhere downstream of the flare system 130, in some embodiments proximate flare exhaust outlet 134.

Flare gas sampling point 152 may be equipped with one or more of an analytical chemistry package containing one or more of ion mobility spectrometry, differential mobility spectrometry, isobaric sampling, isothermal sampling, gas chromatograph, and mass-spectroscopy for flare gas stream profiling.

Exhaust gas sampling point 154 may be equipped with one or more of ion mobility spectrometry, differential mobility spectrometry, real-time optical spectrometry, gas chromatograph, mass-spectroscopy, and one or more ash filters which may be equipped with an optical emitter-detector package for exhaust gas profiling.

The oxidant gas 20 is supplied to flare system 130 by an air supply unit 140. The oxidant gas 20 may be one or more of air, oxygen, or other oxidants as appropriate for the particular process. Additionally, the oxygen supply may be inerted with an inert gas such as nitrogen to control or vary the oxygen concentration in oxidant gas 20. According to one or more embodiments disclosed herein, the oxidant gas 20 comprises air.

An analytical control unit 150 may be provided to receive input signals 162 and 164 from sampling points 152 and 154, respectively. The analytical control unit 150 may be configured to process the results obtained at sampling points 152 and 154 separately or may be configured to compare the results obtained at sampling points 152 and 154 for differential analysis.

Analytical control unit 150 may provide one or more feedback circuits as a result of the analysis or comparison of sampling points 152 and 154 by analytical control unit 150. Feedback circuit 172 may vary the oxidant gas 20 flowrate from air supply 140. Feedback circuit 174 may vary the amount that choke valve 120 is open or closed. Feedback circuit 176 may vary the separator 110 parameters such as separator temperature and separator pressure.

Figure 3:
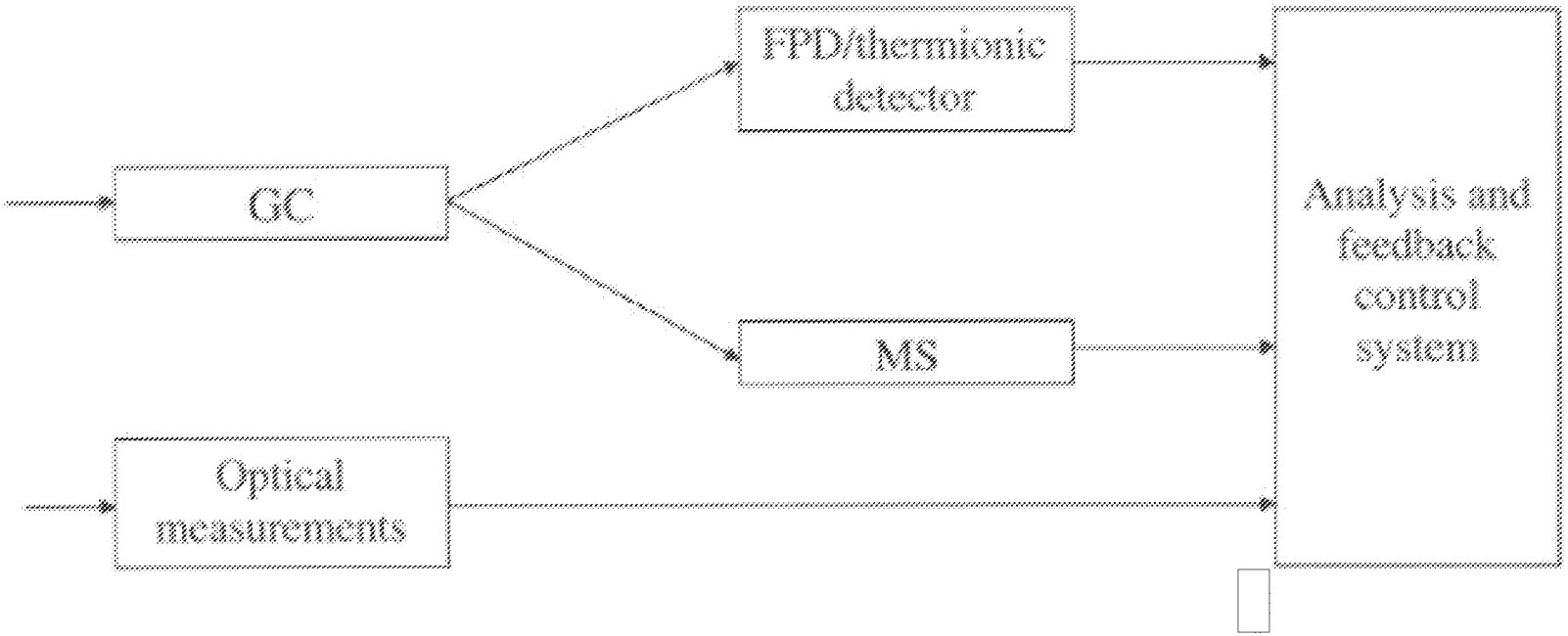
FIG. 3 illustrates an analytical process diagram according to embodiments disclosed herein.

Analytical control unit 150 may be configured to analyze the composition of the flare gas 12, at sampling point 152, which is intended to be burned in flare system 130. This may occur by, or example, a gas chromatography system with flame photometric detector/mass-spectrometer combined with optical spectrometry system (see FIG. 3). To monitor flare system 130 efficiency, the flare exhaust 16 is periodically analyzed at sample point 154 by, for example, gas chromatographic system with flame photometric detector mass-spectrometer combined with optical spectrometry system.

Once analytic control unit 150 has analyzed or compared the results, the amount of oxidant gas 20 needed for complete oxidation of flare gas 12 is calculated and the result is used to signal air supply unit 140, via feedback circuit 172, to increased or decrease oxidant gas 20 flowrate accordingly. In some embodiments, when air supply unit 140 is not capable of providing the required amount of oxidant gas 20 to the flare system 130, the analytical control unit 150 will signal choke valve 120, via feedback line 174, to open or close accordingly, so as to regulate the flare gas 12 supply from separator 110. In other embodiments, when air supply 140 and choke valve 120 are not capable of providing the required flowrate of oxidant gas 20 or flare gas 12, respectively, to flare system 130, the analytical control 150 will signal separator 110, via feedback circuit 176 to vary the separator 110 parameters.

In some embodiments disclosed herein, analytical control unit 150 may vary system conditions in series by, for example, varying the air supply 140 flowrate, then varying choke valve 120 position, then varying separator 110 parameters. In other embodiments disclosed herein, analytical control unit 150 may vary system conditions in series, in parallel, or any combination thereof, for example, increase air supply 140 flowrate while shuttering choke valve 120, then varying separator 110 parameters.

Figure 2:
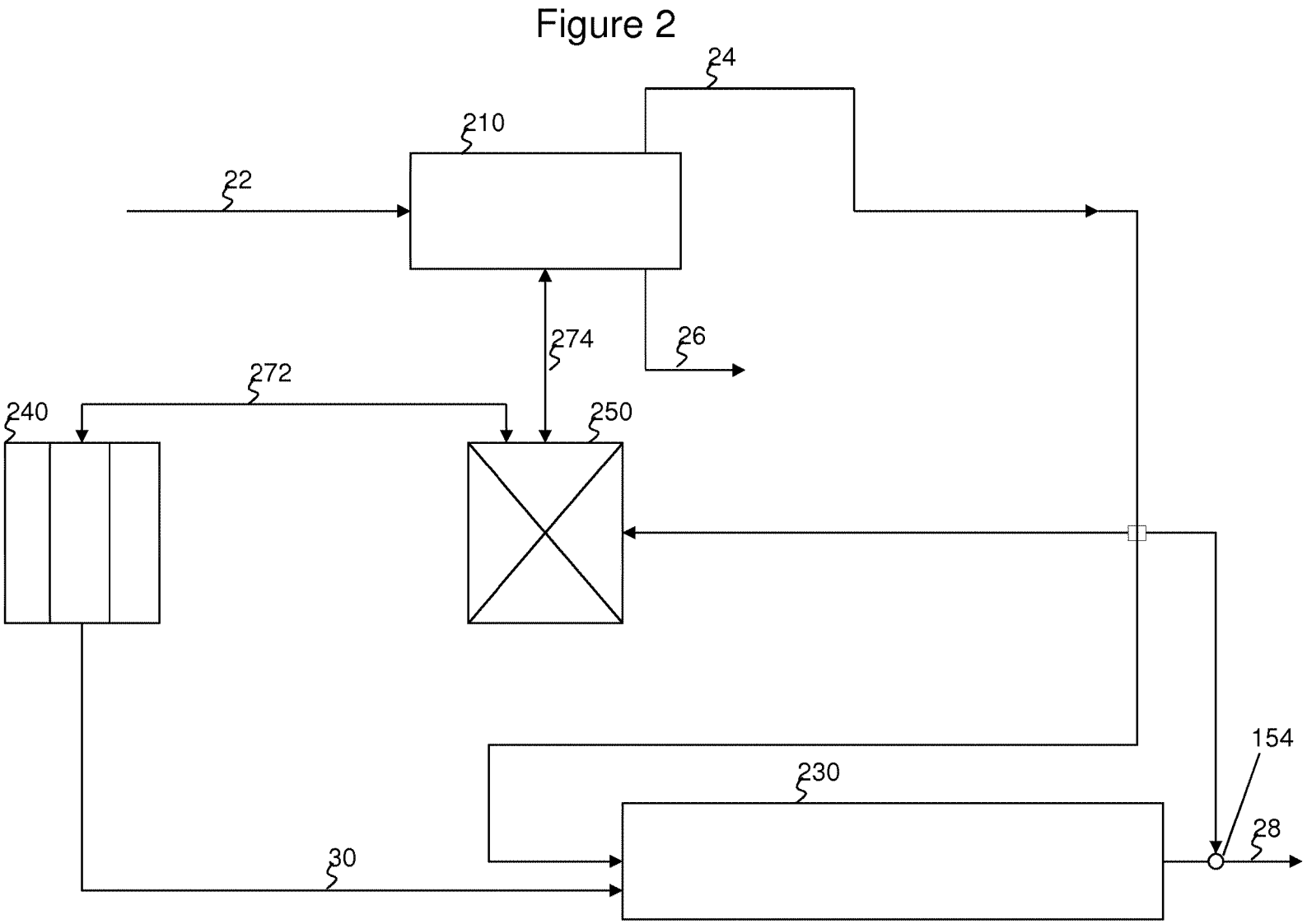
FIG. 2 illustrates a process flow diagram according to embodiments disclosed herein.

According to another embodiment disclosed herein, is a method for a real-time burner efficiency control and monitoring system as illustrated by FIG. 2.

The method includes determining a flare exhaust gas 28 composition at exhaust gas sampling point 254 downstream of flare system 230. An analytical control unit 250 is provided to analyze the exhaust gas 28 from sampling point 254. Analytical control unit 250 identifies specific components in the flare exhaust gas 28 by utilizing one or more chromatographic, spectrometric, and optical systems such as ion mobility spectrometry, differential mobility spectrometry, real-time optical spectrometry, gas chromatograph, and mass-spectroscopy, which have been calibrated accordingly.

Once the composition of flare exhaust gas 28 has been determined, analytical control unit 250 calculates the amount of oxidant gas 30 needed for complete oxidation of flare gas 24 and the result is used to signal air supply unit 240, via feedback circuit 272, to increased or decrease oxidant gas 30 flowrate accordingly. In some embodiments, when air supply unit 240 is not capable of providing the required amount of oxidant gas 320 to the flare system 230, the analytical control unit 250 will signal separator 210, via feedback circuit 276 to vary the separator 210 parameters. Separator 210 parameters include, but are not limited to, separator temperature and separator pressure.

One or more embodiments, as illustrated by FIG. 2, may also include a method of monitoring one or more ash particle filtration units. The method may include light scattering or plane plate capacitance to estimate the size and quantity of the ash particles present in flare exhaust 28.

The light scattering method may utilize one or more ash filtration units which may be equipped with an optical emitter-detector package for exhaust gas 28 profiling. Analytical control unit 250 will analyze the results obtained by the emitter-detector and adjust the oxidant gas 30 flowrate or separator 210 parameters, accordingly, in response to the amount of light scattered.

The plane plate capacitance method may utilize a probe at about 1000V and 250° C. The ash particles would transfer the charge between capacitor's plates and the measured voltage would indicate the relative amount of ash present in the filtration unit. Analytical control unit 250 will analyze the results obtained by the plane plate capacitor and adjust the oxidant gas 30 flowrate or separator 210 parameters, accordingly, in response to the voltage.

The filtration could be performed either by wet methods or dry methods. Wet methods may include absorption, while dry methods may include cyclones, classifiers, filtering materials or electrical ash filters. An electrical ash filter may be represented as a series of parallel conductors. A portion of the conductors may be used to collect the ash particles while the remaining portion of conductors may be used to generate an electrical discharge between electrodes on the order of 10-50 kV.

In addition, ash filter monitoring may be found in the case where there is a presence of specific component that cannot be effectively burned in flare system 230 and that would be harmful to the environment. In this embodiment, the exhaust gas 28 may be directed to the ash filtering module to capture this component. In addition, based on the size of the ash particles, the analytical control unit 250 may vary the oxidant gas 30 flowrate and separator 210 parameters to further optimize flare system 230.

In one or more embodiments, the methods of the disclosure may include calibration of the analytical instrumentation and in conjunction with the flare system. For example, it may be desirable to validate that have full oxidation of the mixture achieved, full oxidation is also measured. Thus, one ore more embodiments may include validation (and if necessary adjustment) of a zero level, performing blank runs for GC/GC-MS/IMS/GCxGC system, and running reference and calibration mixture on these systems to be able to quantify the measured values. For example, this may include translating of the GC peak area to the amount of actual component present in the mixture. Such calibration steps may be performed periodically, on a set schedule, or by observed necessity by an operator.

In one or more embodiments, the methods of the disclosure may include an algorithm for the analytical control unit. In one or more embodiments, if ash particle count is increased the analytical control unit will cause a corresponding increase in stream temperature from the separator, or a catalyst may be activated as needed.

In one or more embodiments, if there is a "high" concentration of hydrocarbon components being detected, the analytical control unit will increase the oxidant gas supply, or a catalyst may be activated as needed. A "high" concentration would be determined empirically, and would be based on local or national rules and regulations for such a process. In some countries the process may be required to oxidize up to 90% of the hydrocarbons, while in other countries the process may be required to oxidize up to 70% of the hydrocarbons.

In one or more embodiments, if there is a "high" concentration of hazardous components in the flare gas exhaust, the analytical control unit will increase the stream temperature from the separator, or a catalyst may be activated as needed. In one or more embodiments, a "high" concentration would be determined using a linear approach method. This method may include using the condition $\Delta x/\Delta y=0$ as a goal criteria (e.g., $\Delta N_{ash\ particles}/\Delta T_{stream}=0$ would indicate that it is not necessary to increase stream temperature).

The systems and methods disclosed herein generally relate to methods and systems for real-time burner control and monitoring. It will be appreciated that the same systems and methods may be used for performing analysis in fields such as oilfield, mining, processing, or in any field where characterization of a flare gas is desired. Furthermore, in accordance with one or more embodiments, the system may be deployed as a stand-alone system (e.g., as a lab-based analytical instrument or as ruggedized unit for field work), or as part of a new flare system installation package. The systems and methods disclosed herein are not limited to the above-mentioned applications and these applications are included herein merely as a subset of examples.

Some of the processes described herein, such as (1) sampling and analyzing the flare gas and flare exhaust gas, (2) identifying specific components in the analyzed gas, (3) adjusting the oxidant gas flowrate or separator parameters, (4) determining presence of ash within the exhaust gas sample, and (5) controlling operation and tuning of the system, can be performed by a processing system.

In one embodiment, the processing system is located near the flare system as part of the analytical control unit. The analytical control unit is in communication with the flare system. In a second embodiment, the analytical control unit is incorporated into the flare system. In yet another embodiment, however, the analytical control unit is located remote from the flare system at an office building or a laboratory to support the analytical instruments described above.

The term "analytical control unit" should not be construed to limit the embodiments disclosed herein to any particular device type or system. In one embodiment, the analytical control unit includes a computer system. The computer system may be a laptop computer, a desktop computer, or a mainframe computer. The computer system may include a graphical user interface (GUI) so that a user can interact with the computer system. The computer system may also include a computer processor (e.g., a microprocessor, microcontroller, digital signal processor, or general purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. This memory may be used to store, for example, data from analytical instruments.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Additionally, the analytical control unit may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Although only a few example embodiments have been described in detail above, those skilled in the art will readily appreciate that many modifications are possible in the example embodiments without materially departing from this disclosure. Accordingly, such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A real-time burner efficiency control and monitoring system, the system including:

a flow header configured to feed a multiphase flare mixture to the system;

a separator that is configured to receive the multiphase flare mixture from the flow header, and separate the multiphase flare mixture into two or more fractions including a gas fraction and a liquid fraction, wherein the separator separates the multiphase flare mixture based upon, at least in part, an efficiency of the flare system;

a valve, located downstream from the separator, configured to control the flowrate of the gas fraction exiting the separator;

a flare system, located downstream from the valve, for the handling and burning of the gas fraction;

an air supply unit for supplying oxidant gas, at an adjustable flowrate, to the flare system for gas fraction combustion;

a gas fraction sampling point downstream of the separator and upstream of the flare system for sampling the gas fraction prior to admixture with the oxidant gas;

an exhaust mixture sampling point downstream of the flare system for sampling an exhaust mixture from the flare system; and an analytical control unit configured to compare the gas fraction sampled at the flare gas sampling point with the exhaust mixture sampled at the exhaust mixture sampling point and provide feedback, based on the comparison, to adjust at least one parameter of the separator.

2. The system of claim 1, wherein the analytical control unit provides feedback for adjustment of at least one of the air supply flowrate, separator pressure, separator temperature, or valve position.

3. The system of claim 1, further comprising:

one or more of ion mobility spectrometry, differential mobility spectrometry, isobaric sampling system, isothermal sampling system, gas chromatograph, or mass-spectroscopy for profiling of the gas fraction at the gas fraction sampling point.

4. The system of claim 1, further comprising:

one or more of ion mobility spectrometry, differential mobility spectrometry, realtime optical spectrometry, gas chromatograph, or mass-spectroscopy for profiling of the exhaust mixture at the exhaust mixture sampling point.

5. The system of claim 1, further comprising:

one or more feedback circuits for the analytical control unit to vary the air supply, valve, or separator parameters.

6. The system of claim 1, wherein the flare system further comprises:

a gas fraction inlet;

an exhaust mixture outlet, an oxidant gas inlet, and a flare header containing at least one pilot flame.

7. The system of claim 1, wherein the separator further comprises one or more of: a wet/dry gas separator, a liquid/gas hydrocarbon separator, and a water knock out separator.

8. The system of claim 1, wherein the oxidant gas comprises one or more of: air, oxygen, and methane.

9. A method for a real-time burner efficiency control and monitoring system, the method including:

analyzing a flare exhaust mixture composition at an exhaust mixture sampling point downstream of a flare system;

identifying specific components in the flare exhaust mixture utilizing one or more of a chromatographic, spectrometric, or optical systems;

adjusting at least one parameter of an upstream flow separator based on the analysis of the flare exhaust mixture composition, wherein a valve is fluidly coupled to and between the flow separator and the flare system;

adjusting an oxidant supply flowrate to the flare system based on the analysis of the flare exhaust mixture composition, wherein the oxidant comprises one or more of air or oxygen or methane, and wherein the at least one parameter of the upstream flow separator includes separator temperature and pressure.

10. The method of claim 9, further comprising:

monitoring of one or more ash filtration units by at least one of light scattering or plane plate capacitors to estimate the size and/or amount of the ash particles present in the flare exhaust; and adjusting an oxidant supply flowrate to the flare system or the at least one separator parameter in response to the amount of light scattered or voltage reading.

11. The method of claim 9, wherein the one or more of chromatographic, spectrometric, or optical systems are calibrated for flare exhaust monitoring, and wherein one or more of ion mobility spectrometry, differential mobility spectrometry, real-time optical spectrometry, gas chromatograph, or mass-spectroscopy are utilized for identifying components of the flare exhaust mixture.

12. The method of claim 9, wherein an analytical control unit provides feedback for the adjustment of the at least one separator parameter and oxidant supply flowrate to the flare system based on the identified composition of the flare exhaust mixture or at least one gas fraction of a multiphase flare mixture supplied to the flow separator.

13. A method for a real-time burner efficiency control and monitoring system, the method including:

feeding a flare mixture to the system through a flow header;

separating the flare mixture received from the flow header into one or more fractions in a separator, the one or more fractions including a gas fraction;

feeding the gas fraction to a valve, located downstream of the separator, configured to control the flowrate of the gas fraction exiting the separator;

burning the gas fraction in a flare system downstream from the valve;

analyzing a flare exhaust mixture composition at an exhaust mixture sampling point downstream of the flare system;

identifying specific components in the flare exhaust mixture utilizing one or more of a chromatographic, spectrometric, or optical systems;

analyzing the gas fraction at a gas fraction sampling point downstream of the separator and upstream of the flare system;

monitoring flare burner efficiency by differential composition analysis, between the gas fraction and flare exhaust mixture;

adjusting at least one parameter of the flow separator based on a comparison of results obtained at the gas fraction sampling point and the exhaust mixture sampling point; and adjusting oxidant supply flowrate to the flare system, wherein the at least one separator parameter includes separator temperature and pressure.

14. The method of claim 13, wherein specific components are identified in the gas fraction by utilizing one or more of a chromatographic, spectrometric, or optical systems.

15. The method of claim 13, wherein differential composition analysis further comprises calibrating the one or more of chromatographic, spectrometric, or optical systems for flare exhaust mixture monitoring, and comparing samples taken from the gas fraction and the flare exhaust mixture sampling points in an analytical control unit.

16. The method of claim 13, wherein an air supply unit supplies oxidant gas, at an adjustable flowrate, to the flare system for flare gas combustion.

17. The method of claim 15, wherein the analytical control unit compares the results obtained at each sampling point and provides feedback for adjustment of at least one of oxidant supply flowrate to the flare system, separator pressure, separator temperature, or valve position.

18. The method of claim 15, further comprising:

monitoring of ash filtration units by at least one of light scattering or plane plate capacitance to estimate the size and amount of the ash particles present in the flare exhaust mixture and controlling an oxidant supply flowrate or separator parameters in response to the amount of light scattered or voltage reading.

19. The system of claim 1, wherein the separator separates the multiphase flare mixture when the efficiency of the flare system is low.

* * * * *